United States Patent [19]

Barradas

[11] Patent Number: 5,033,487

[45] Date of Patent: Jul. 23, 1991

[54] HAIR CURLER DEVICE

[76] Inventor: George Barradas, 15 Riverview Ct., Greenwich, Conn. 06831

[21] Appl. No.: 495,168

[22] Filed: Mar. 19, 1990

[51] Int. Cl.[5] ..... A45D 2/30

[52] U.S. Cl. ..... 132/254; 132/253; 132/255; 132/263; 132/265; 132/266

[58] Field of Search ..... 132/223, 226, 245, 247, 132/250, 253, 254, 255, 261, 263, 264, 265, 266, 267

[56] References Cited

U.S. PATENT DOCUMENTS

| | | | |
|---|---|---|---|
| 404,501 | 6/1889 | Pfanne | 132/253 |
| 2,276,165 | 3/1942 | Custis | 132/245 |
| 2,430,766 | 11/1947 | Gregory | 132/245 |
| 2,452,225 | 10/1948 | Coloccia | 132/247 |
| 2,555,933 | 6/1951 | Renstrom | 132/247 |
| 2,698,623 | 1/1955 | Weaver et al. | 132/266 |
| 2,713,864 | 7/1955 | Solomon | 132/253 |
| 2,742,046 | 4/1956 | Iurewicz | 132/267 |
| 2,750,948 | 6/1956 | Lutz | 132/265 |
| 2,863,462 | 12/1958 | Lawson | 132/254 |
| 2,888,019 | 5/1959 | Whitmore | 132/247 |
| 3,200,824 | 8/1965 | Coloccia | 132/254 |

FOREIGN PATENT DOCUMENTS

| | | | |
|---|---|---|---|
| 26894 | 10/1954 | Finland | 132/226 |
| 1564470 | 4/1969 | France | 132/245 |
| 457256 | 8/1951 | Italy | 132/253 |
| 904399 | 8/1962 | United Kingdom | 132/266 |

*Primary Examiner*—John J. Wilson
*Assistant Examiner*—Frank A. LaViola
*Attorney, Agent, or Firm*—Alfred E. Miller

[57] ABSTRACT

A hair curler having a spool portion that is flexible and an attached cover of relatively rigid material adapted to be slid from an open to closed position and vice versa, over said spool portion after hair is wound thereon. A further hair curler has a flexible spool portion with a base flange at one end and a cup-like flange at the other end, said cup-like flange having a rigid rim which can be pushed over said base flange after hair is wound on said spool.

8 Claims, 5 Drawing Sheets

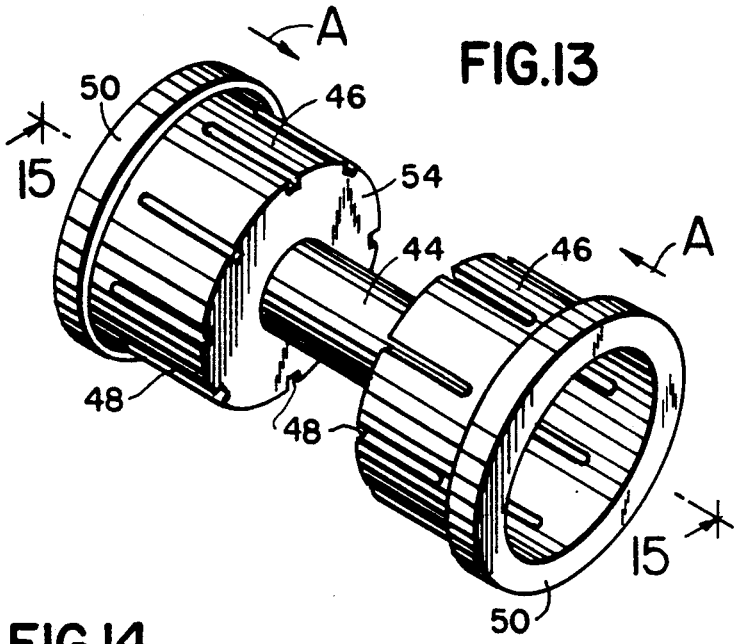
FIG.13
FIG.14
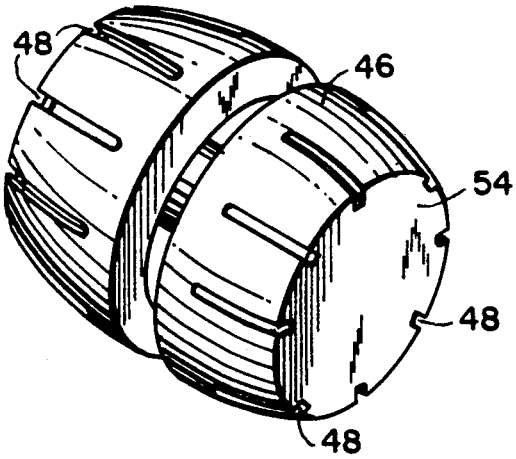
FIG.15
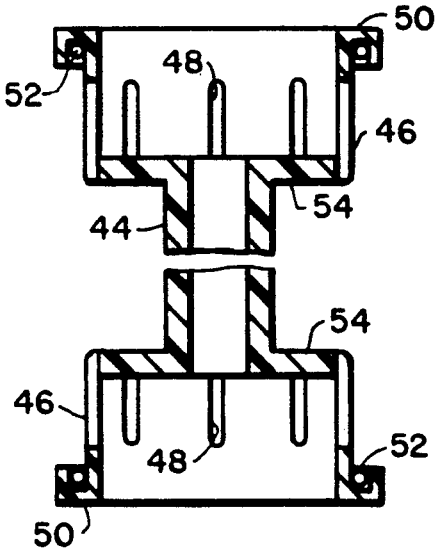
FIG.16
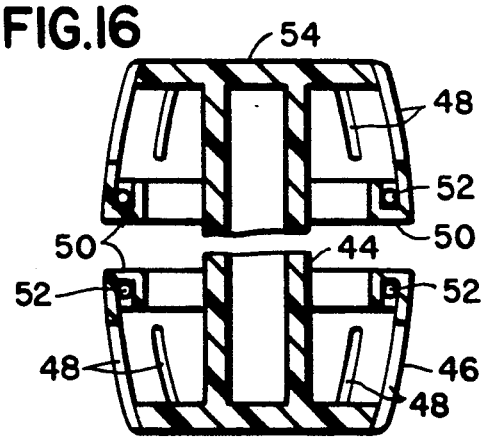
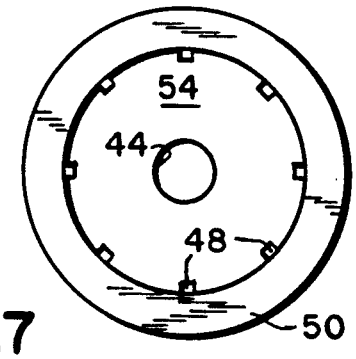
FIG.17

FIG.18
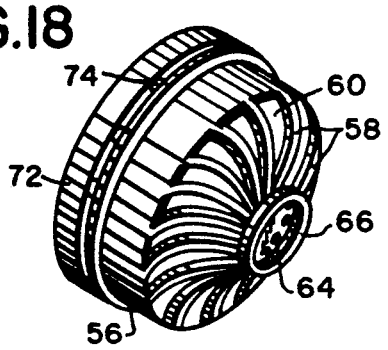
FIG.19
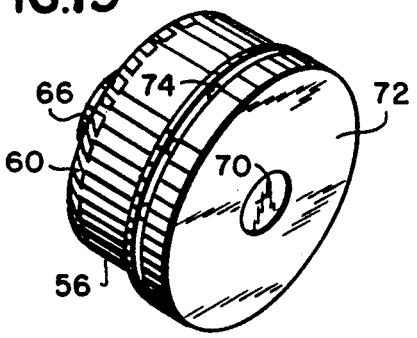
FIG.20
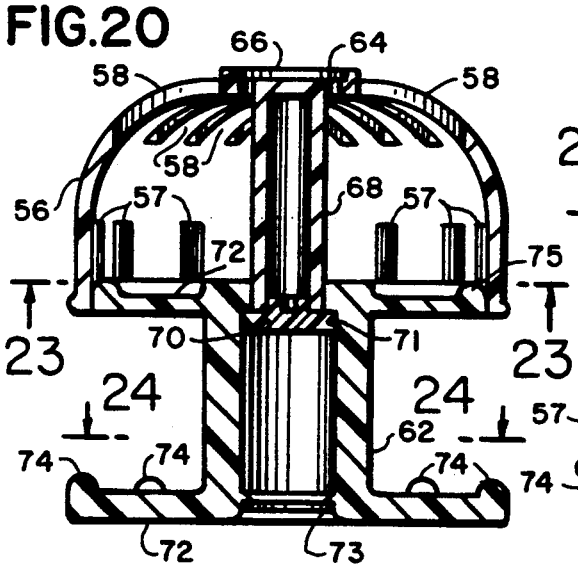
FIG.21
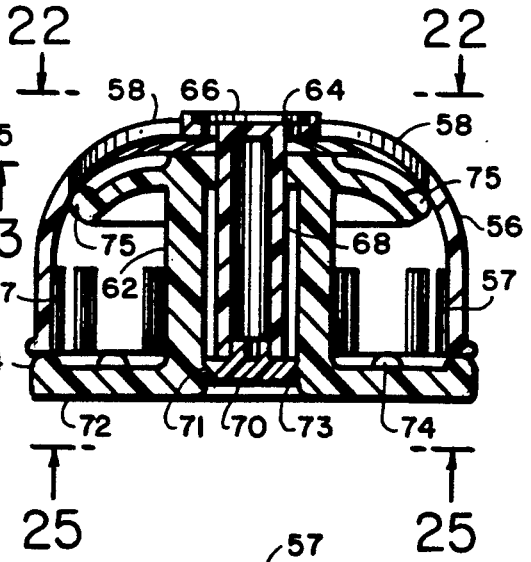
FIG.22
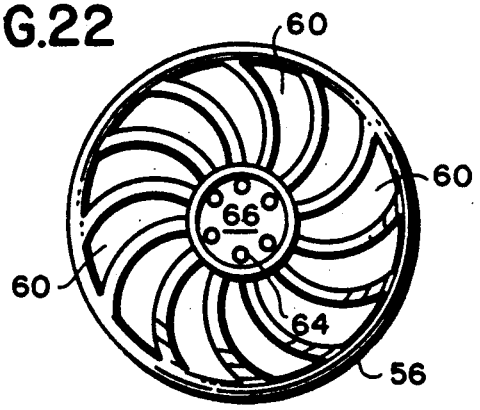
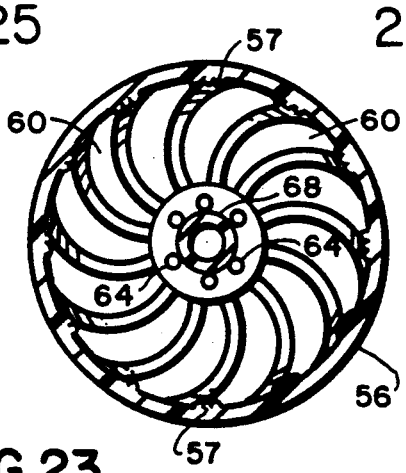
FIG.23

HAIR CURLER DEVICE

The present invention relates to a spool hair curler adapted to be heated on a heating post and fabricated from a flexible material and having a slidable cylinder over a spool-like body portion Another embodiment of the invention is the utlization of a flexible spool-like hair curler having a cup-shaped portion provided with a rigid rim which can be manually pushed over an opposite flange of the spool.

SUMMARY OF THE INVENTION

An object of the present invention is to provide a flexible spool having a base flange on one end and a cup-shaped cylinder at the other end thereof of a rigid material having solid sides or spaced slits in the sides. The hollow center of the spool hair curling device is adapted to be placed upon a heated post for transmitting heat thereto, and the rigid cup-like element slid over the spool after the hair is wound thereon in order to capture the hair to be curled on the spool.

Another object of the present invention is to provide a hair curler having a spool-like body portion provided with a disc-shaped flange base portion on one end of the body portion and a cup-shaped flange on the opposite end thereof. The cup-shaped flange is fabricated of a flexible material, such as silicone, so that that flange can be bent over the flange base after hair is wound around the spool-like body portion in order to capture the hair on the spool.

A further feature of the present invention is a hair curler having a spool-like center portion and cup-like flanges on opposite ends thereof. The device is fabricated of a flexible material, such as silicone, and is provided at one opposite end with a polypropylene or metallic ring. The elongated spool element is hollow so that hair can be wound thereon for curling purposes after the spool is heated on a heating post and the cup-like flanges are thereafter bent over towards each other and towards the middle of the spool in order to cover the device, with the exception of a annular space therebetween. The body portion of the hair curler device is flexible so that the rim can be pushed down over the spool flange base, and latched thereon by means of the rigid rim fitting around the base and held thereon by the resilience of the hair curler device. The rim, which is preferable circular, can be made of a metallic material or a plastic, such as polypropylene. The cup-like flange at one end of the spool is provided with a series of vertical slots about its periphery. Since the spool is hollow it is adapted to be inserted over a heated post for transmitting heat to the entire hair curler device.

BRIEF DESCRIPTION OF THE DRAWINGS

In order that the invention may be clearly understood it will now be disclosed in further detail with reference to the accompanying drawings.

FIG. 13 is a perspective view of a further embodiment of the present invention shown in an open position.

FIG. 14 is a view of the construction shown in FIG. 13 but in a closed position.

FIG. 15 is a view taken along the lines 15—15 of FIG. 13.

FIG. 16 is a sectional view of the closed construction shown in FIG. 14.

FIG. 17 is a bottom plan view construction shown in FIGS. 14 and 16.

FIG. 18 is a top perspective view of yet another embodiment of the present invention shown in a closed position.

FIG. 19 is a bottom perspective view of the construction shown in FIG. 18.

FIG. 20 is an enlarged sectional view of the embodiment shown in FIGS. 18 and 19 in an open position.

FIG. 21 is a cross sectional view similar to FIG. 21 but showing the spool hair curler in a closed position.

FIG. 22 is a view taken along the lines 22—22 of FIG. 21.

FIG. 23 is a view taken along the lines 23—23 of FIG. 20.

DESCRIPTION OF THE PREFERRED EMBODIMENTS

Figure 1:
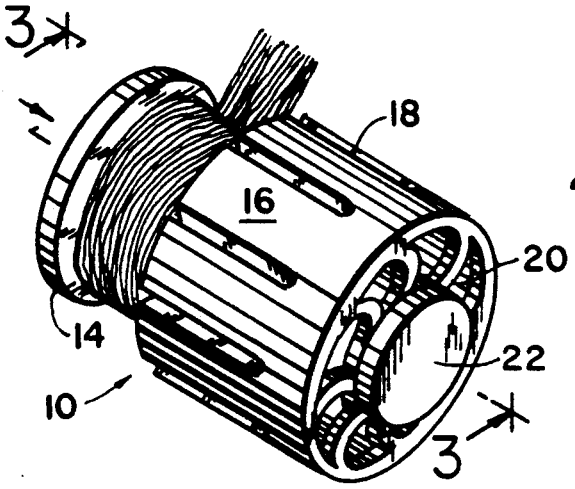
FIG. 1 is a perspective view of the hair curler device constructed in accordance with the teachings of the present invention in an open position with the hair wound around the spool portion.
Figure 2:
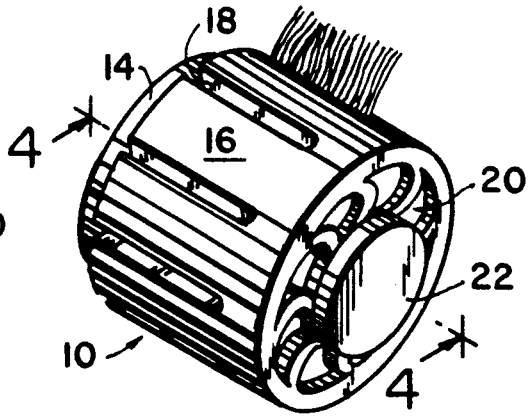
FIG. 2 is a perspective view of the hair curler device in FIG. 1 in a closed position.

Referring to FIGS. 1-6, a hair curler device referred to generally by the numeral 10 is shown having a spool-like body portion 12 provided with a base flange 14. Attached to and slidable on the spool 12 is a rigid cylinder 16 having spaced slits 18 and vent openings 20, as well as a solid center button 22 in the top thereof.

Figure 3:
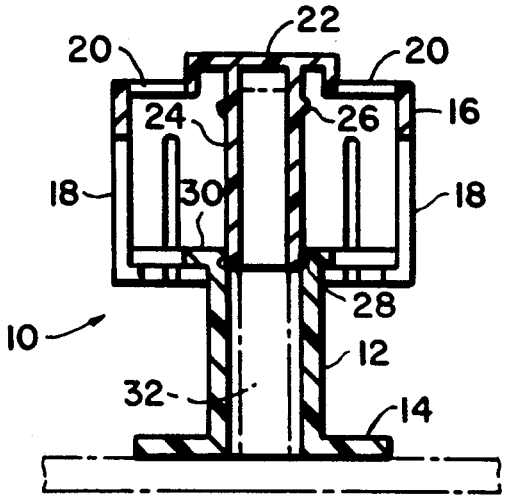
FIG. 3 is a sectional view taken along the lines 3—3 of FIG. 1 showing the present hair curler device on the heating post.
Figure 4:
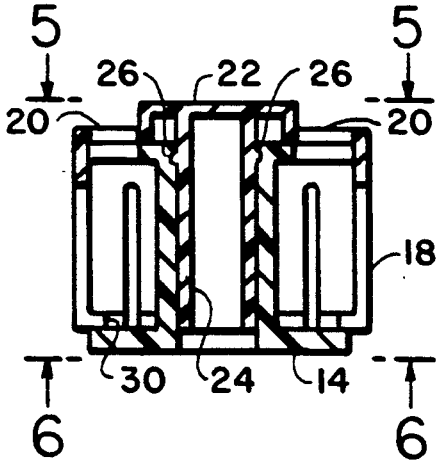
FIG. 4 is a sectional view taken along the lines 4—4 of FIG. 2 showing the hair curler device in its closed position.

As seen in FIGS. 3 and 4, the cylinder 16 is provided with a center tube 24 depending from the top button 22, with the tube having spaced, small rounded projections 26 at the top thereof. Furthermore, as is particularly seen in FIG. 3, the correspondingly shaped rounded depressions or recesses 28 are provided on the inside surface of the spool 12 adjacent to flange 30 located opposite to the base flange 14 of the spool. Consequently, after hair is wound around the spool, as seen in FIG. 1, and the cylinder slid from an open position of FIG. 1 to a closed position shown in FIG. 2, the tube 24 slides within the spool 12 until the top of the cylinder 16 abuts the flange 30. In that position the rounded projections 26 snap into the depressions 28 of the flexible spool 12. This is clearly shown in FIG. 4 of the drawings.

Figure 5:
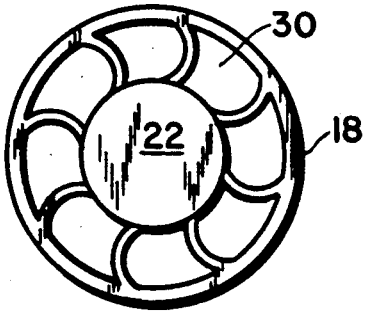
FIG. 5 is a view taken along the lines 5—5 of FIG. 4.
Figure 6:
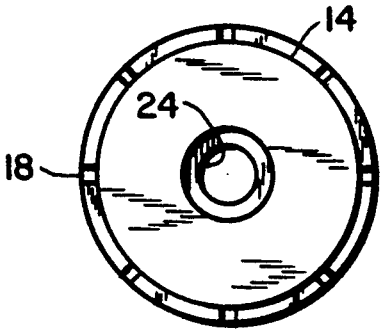
FIG. 6 is a view taken along the lines 6—6 of FIG. 4.

It should also be noted that hair curling device, prior to operation, is placed over a heating post 32 as illustrated in FIG. 3 of the drawings, and thereby transmits sufficient heat to the hair curler device in order to accomplish the curling of the user's hair. The vents 20, as seen in FIG. 5, are for the purpose of venting heat and moisture from the hair curler device.

Figure 7:
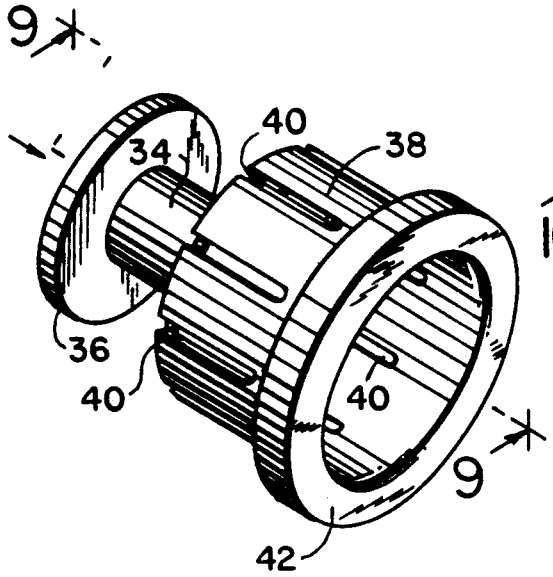
FIG. 7 is a perspective view of an alternate embodiment of the present invention shown in an open position.
Figure 8:
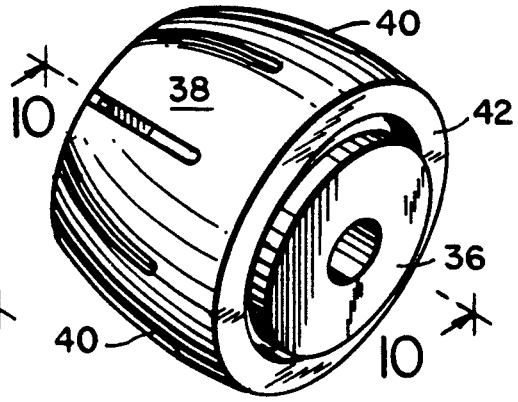
FIG. 8 is a view of the construction shown in FIG. 7 but in a closed position.
Figure 9:
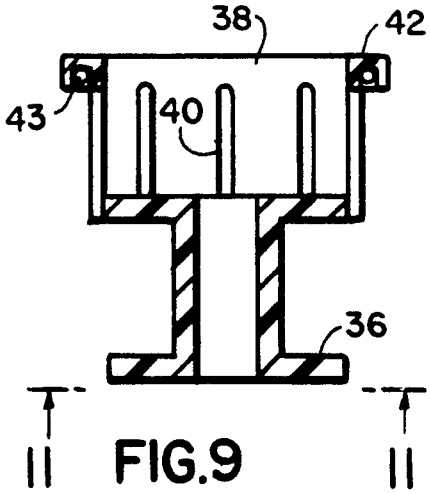
FIG. 9 is a sectional view taken along the lines 9—9 of FIG. 7.
Figure 10:
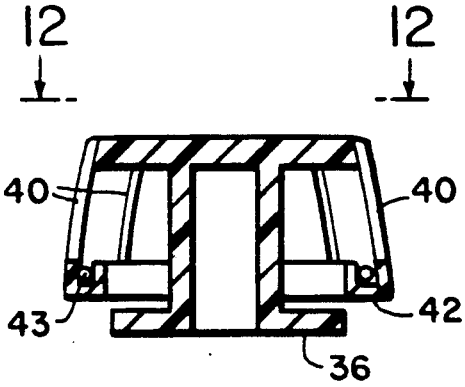
FIG. 10 is a sectional view taken along the lines 10—10 of FIG. 8.
Figure 11:
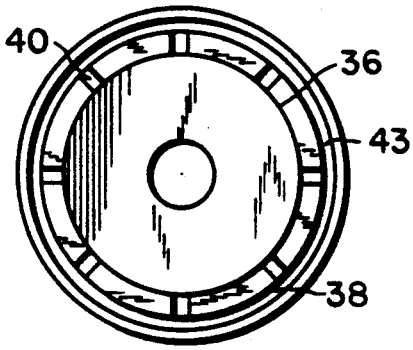
FIG. 11 is a bottom plan view taken along the lines 11—11 of FIG. 9
Figure 12:
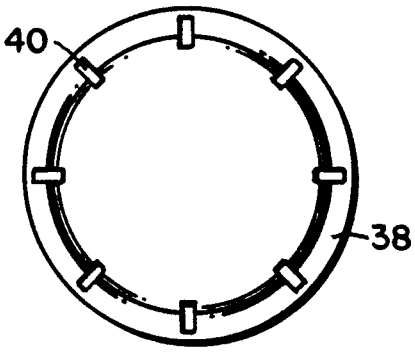
FIG. 12 is a top plan view taken along the lines 12—12 of FIG. 10.

Referring now to an alternate embodiment of the present invention as shown in FIGS. 7–12 a spool-like hair curler device is illustrated which is preferably of a one piece flexible construction, for example of silicone. The spool 34 is provided with a base flange 36 at one end. A cup-like flange 38 is provided with spaced slits 40 and a rigid annular rim 42 is provided at the opposite end of the spool. FIG. 7 shows the hair curler device in an open position while FIG. 8 shows the same device in a closed position having the rigid rim 42 pushed down over the flange 38, and forced over the base flange 36 to be held in place thereon. As described hereinbefore and in connection with the embodiment of FIGS. 1–6, the user'air is wound around the spool 34 after the device is heated on a heating post, and in this embodiment, however, the rigid rim 42 is manually pushed down over the flange 38 and into engagement with the bottom of the base flange 36.

Referring now to a further embodiment of the present invention as shown in FIGS. 13–17, the hair curler device is provided with a central spool 44 and cup-shaped flanges 46 at opposite ends of the spool 44 which are fabricated of a flexible or resilient material. Each of the cup-shaped flanges 46 is preferably provided with spaced slits 48 along the annular periphery thereof. As seen in FIGS. 13, 15 and 16 the open end of each cup-shaped flange has an annular rim 50. It should be noted that the user's hair is wound around the spool 44 in the same manner as shown in FIG. 1 and the hollow device is placed upon the heating post of the type shown in FIG. 3 until sufficient heat is transmitted to the hair curler device. After hair is wound around the spool 44 the cup-shaped flanges 46 are manually pushed inwardly relative to the spool and form a substantially closed construction over the hair wrapped around the spool 44, as seen in FIG. 14. In addition, an opening 54 remains between the spaced flanges in the closed position to enable the further venting of heat and moisture from the device. As particularly seen in FIG. 15, each of the rims 50 is provided with a rigid annular element 52 which provides enough stiffness to hold the hair curler device in a closed position when the cup-like flanges 46 are pushed in a direction towards each other as illustrated by the arrows A, and assume the cylindrical position shown in FIG. 14. It should also be noted the base 54 of the cup-like flange 46 has sufficient rigidity so that it will remain in a position substantially at right angles to the axis of the spool 44 when the cup-like flanges 46 are moved in a direction towards each other, and assume the positions shown in FIGS. 14 and 16.

In connection with FIGS. 18–25, which is an alternate embodiment of the present invention, it is to be noted that the cover 56 has a rounded top portion 58 provided with a series of curvilinear openings 60 permitting heat and moisture to escape from the hair curling device after it is heated on the heating post, such as heating post 32 as shown in FIG. 3 of the drawings. FIGS. 18, 19 and 21 show the hair curler device in a closed position while FIG. 20 show the device in the open position prior to winding the hair around the spool element 62. Furthermore, it should be apparent that the hair curling device, as shown in FIGS. 18–25, is similar in construction to that shown and described in connection with FIGS. 1–6 of the present application.

The spool element 62 is fabricated, for example, of silicone rubber while the slidable cover 56 is preferably manufactured from a semi-rigid plastic, such as polypropylene. Similarly to that shown in FIG. 3 the hollow roller 62, as shown in FIG. 20, is suitable for insertion upon the heating post (not shown) so that sufficient heat is conducted to the roller for curling the hair. Furthermore, as seen in FIGS. 20 and 21, the roller cover 56 with a rounded top 58 can be slid over the body of the spool 62 after the hair is wound thereon in order to retain the hair on the spool for curling purposes, as specifically shown in FIGS. 1 and 2 of the drawings. In order to prevent the cover from overheating further holes or apertures 64 are present in the central button 66 in the rounded top 58 of the cover 56. Moreover, the cover 56 is also provided with a central hollow tube or post 68 having an end cap or disc 70, as clearly seen in FIGS. 20 and 21 of the drawings.

As seen in FIGS. 20 and 21 the upper flange 75 of the spool 23 being fabricated of a flexible plastic, for example silicone rubber, moves over spaced shallow interference ribs 57 when the cover 56 is moved to closed position as shown in FIG. 21 and the flange 75 bends upon engagement within the inside top surface of the cover 56 to thereby conform the inner configuration of the rounded top 58 of the cover 56. In this position the ribs 57 prevent the cover from moving to the open position of FIG. 20 unless the flange 75 is manually forced downwardly over the ribs 57. In addition to, the end or disc cap 70 of the tube 68 the spool 62 is provided with an annular groove 71 in the central opening of flange 72 which snaps over an annular peripheral edge 73 of the disc 70 when the hair curler device is in the position shown in FIG. 21, to thus latch the cover 56 on the spool 62.

Figure 24:
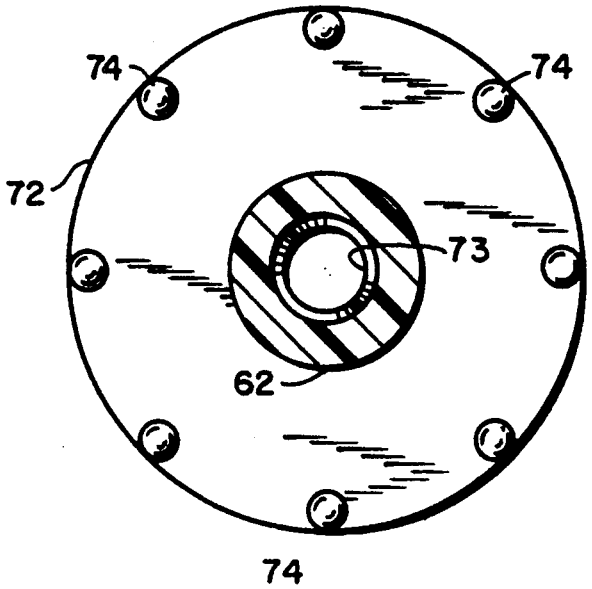
FIG. 24 is a view taken along the lines 24—24 of FIG. 20.
Figure 25:
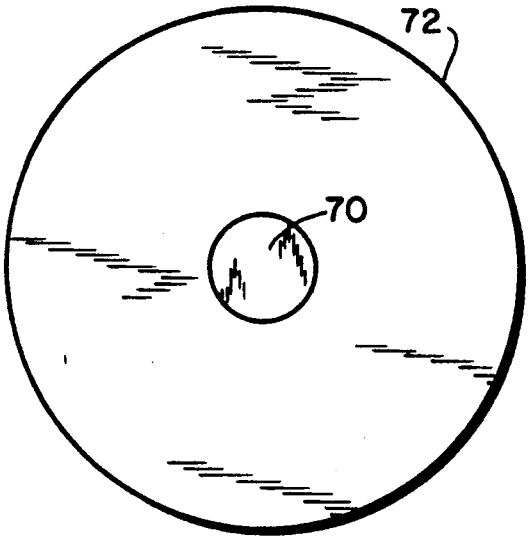
FIG. 25 is a view taken along the lines 25—25 of FIG. 21.

The base 72 of the hollow spool 62 is provided with a series of rounded projections 74, as seen in FIGS. 20 and 24, providing stop members for engaging the slidable cover 56 when it reaches its closed position, as seen in FIG. 21, and additionally serves to provide a space between the bottom peripheral edge of the cover 56 and the top surface of the base 72, thus permitting the user's hair to be held in the confined spaces when the cover is in the closed position and to prevent the hair from unwinding during the curling procedure. It should therefore be evident that the present roller hair curler device is provided with a slidable cover for a hair curling hollow spool, with the cover having a central hollow tube slidable within the hollow spool whereby the cover entraps the user's hair which has been wound around a heated spool, in order to curl the hair while retaining the hair on the spool when the cover is in the closed position of FIG. 21.

While the present invention has been disclosed and described with reference to certain embodiments thereof it is apparent that other variations and modifications may be made which fall within the true spirit and scope of the inventions, as defined in the following claims:

What is claimed is:

1. A hair curler device comprising a body member in the form of a hollow spool for insertion over a heating post and having spaced, flexible flanges on opposite ends thereof, said hollow spool having an elongated bore, an annular groove in one of said flanges, a semi-rigid cover mounted on said spool and slidable over said spool and movable from an open position wherein said spool is uncovered to a closed position in which the spool is substantially covered, said cover being provided with a depending post having a disc at the free end thereof of a greater diameter than the diameter of said post, and said post being movable in said bore when the cover is moved from said open position to said closed position wherein in the latter position said disc latches into said groove to thereby retain said cover in a closed position after said hair is wound around said spool.

2. A hair curler device as claimed in claim 1 wherein the top of said cover is provided with a plurality of vent openings.

3. A hair curler device as claimed in 1 wherein said flexible body member is fabricated of silicone.

4. A hair curler device as claimed in claim 1 wherein said cover is cylindrical and is further provided with spaced ribs along the periphery thereof and a solid center button in the top of said cover having a plurality of openings therein.

5. A hair curler as claimed in claim 1 wherein said post is cylindrical and said disc and groove have circular configurations, and said disc having a slightly larger diameter than said groove.

6. A hair curler as claimed in claim 1 wherein an annular space remains between said cover and the adjacent flange in its closed position, and spaced projections in said annular space for holding the user's hair and preventing said hair from unwinding during the curling procedure.

7. A hair curler device comprising a body member in the form of a hollow spool for insertion over a heating post and having spaced, flexible flanges on opposite ends thereof, said hollow spool having an elongated bore, an annular groove in one of said flanges, a semi-rigid cover mounted on said spool and slidable over said spool and movable from an open position wherein said spool is uncovered to a closed position in which the spool is substantially covered, said cover being provided with a depending post having a disc at the free end thereof of a greater diameter than the diameter of said post, said post being movable in said bore when the cover is moved from said open position to said closed position wherein in the latter position said disc latches unto said groove to thereby retain said cover in a closed position after said hair is wound around said spool, and the other flexible flange proximate to said cover being urged against the inside surface of said rounded top of said cover in the closed position of said hair curler device to thereby conform to the shape thereof.

8. A hair curler as claimed in claim 7 wherein said cover is circular and the skirt of said cover is solid.

* * * * *